US008133296B2

(12) United States Patent
Reichel et al.

(10) Patent No.: US 8,133,296 B2
(45) Date of Patent: Mar. 13, 2012

(54) PROCESS FOR PRODUCING STAINLESS STEEL USING DIRECT REDUCTION FURNACES FOR FERROCHROME AND FERRONICKEL ON THE PRIMARY SIDE OF A CONVERTER

(75) Inventors: Johann Reichel, Duesseldorf (DE); Lutz Rose, Duisburg (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 18 days.

(21) Appl. No.: 12/734,341

(22) PCT Filed: Oct. 22, 2008

(86) PCT No.: PCT/EP2008/008928

§ 371 (c)(1),
(2), (4) Date: Jul. 9, 2010

(87) PCT Pub. No.: WO2009/053044

PCT Pub. Date: Apr. 30, 2009

(65) Prior Publication Data

US 2010/0288078 A1 Nov. 18, 2010

(30) Foreign Application Priority Data

Oct. 23, 2007 (DE) ..... 10 2007 050 478

(51) Int. Cl.
*C21B 13/12* (2006.01)

(52) U.S. Cl. ..... 75/10.63; 75/433; 75/584

(58) Field of Classification Search ..... 75/10.63, 75/433, 584

See application file for complete search history.

(56) References Cited

U.S. PATENT DOCUMENTS

| | | | | |
|---|---|---|---|---|
| 3,728,101 | A | 4/1973 | d'Entremont | |
| 3,947,267 | A | 3/1976 | d'Entremont | |
| 4,488,903 | A * | 12/1984 | Mehlman | 75/537 |
| 5,017,220 | A | 5/1991 | Tanabe | |
| 5,039,480 | A | 8/1991 | Tanabe | |
| 5,047,082 | A | 9/1991 | Tanabe | |
| 5,514,337 | A | 5/1996 | Groger et al. | |
| 5,611,838 | A | 3/1997 | Fritz | |
| 6,228,137 | B1 | 5/2001 | Guillot | |
| 6,238,453 | B1 * | 5/2001 | Rose et al. | 75/10.63 |
| 6,455,488 | B1 | 9/2002 | Assmann | |
| 6,689,189 | B1 | 2/2004 | Goemerup | |

(Continued)

FOREIGN PATENT DOCUMENTS

EP 0 637 634 A1 2/1995

(Continued)

OTHER PUBLICATIONS

Ernst, F. et al. Derwent Acc No. 2005-20237 for Patent family including JP 2007-506857. Earliest publication date is AT 200300976 A published Jun. 15, 2004.*

(Continued)

*Primary Examiner* — George Wyszomierski
*Assistant Examiner* — Tima M McGuthry Banks
(74) *Attorney, Agent, or Firm* — Abelman, Frayne & Schwab

(57) ABSTRACT

In order to allow a significant reduction of the steel production cost when producing stainless steel with the alloying elements chromium and nickel, according to the invention, it is proposed to perform the intermediate production of ferrochrimium and ferronickel in two separate direct reduction processes based on low-cost chromium ore and nickel ore in two SAF (3, 4) arranged in parallel on the primary side of a processing converter (6).

7 Claims, 1 Drawing Sheet

U.S. PATENT DOCUMENTS

| | | | | |
|---|---|---|---|---|
| 2003/0230163 | A1 * | 12/2003 | Pleschiutschnigg et al. | 75/10.42 |
| 2006/0260435 | A1 | 11/2006 | Rose | |

FOREIGN PATENT DOCUMENTS

| | | | |
|---|---|---|---|
| EP | 1 230 404 | B1 | 8/2002 |
| EP | 1 641 946 | B1 | 4/2006 |
| WO | WO 97/20954 | | 6/1997 |
| WO | WO 99/23264 | | 5/1999 |
| WO | WO 01/86006 | | 11/2001 |
| WO | WO 03/106716 | | 12/2003 |

OTHER PUBLICATIONS

Machine translation of JP 2007-506857 publsihed Mar. 22, 2007.*

* cited by examiner

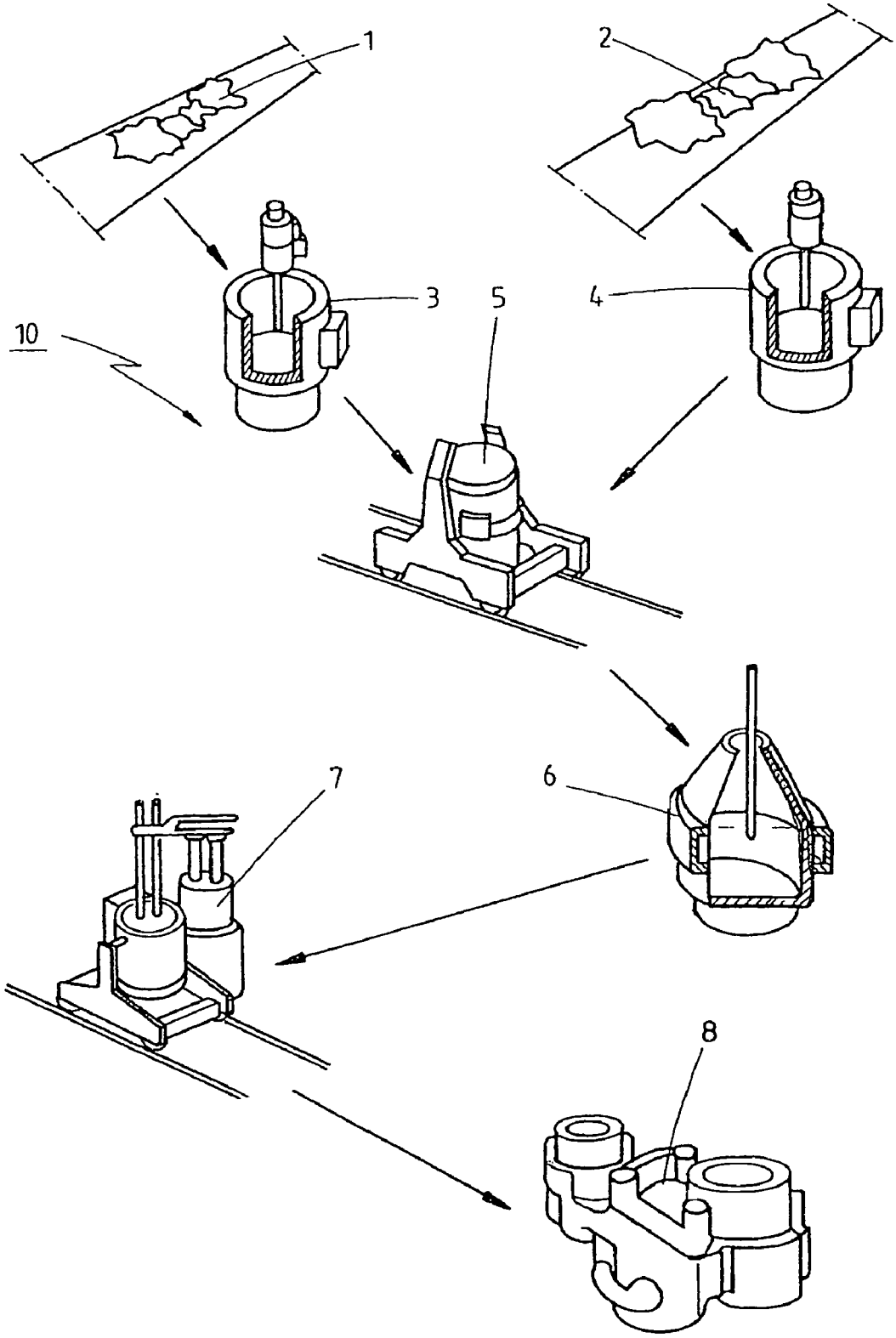
1
2
3
4
5
10
6
7
8

PROCESS FOR PRODUCING STAINLESS STEEL USING DIRECT REDUCTION FURNACES FOR FERROCHROME AND FERRONICKEL ON THE PRIMARY SIDE OF A CONVERTER

RELATED APPLICATIONS

The subject application is a National Stage application of an International Application PCT/EP 2008/008928 filed Oct. 22, 2008 that claims priority of German application DE 10 2007 050 478.2 filed Oct. 23, 2007.

BACKGROUND OF THE INVENTION

1. Field of the Invention;

The invention relates to a process for producing stainless steel based on chromium ore and nickel ore in several process steps coordinated via the intermediate products ferrochromium and ferronickel.

2. Description of the Prior Art.

The process lines for stainless steel established so far worldwide almost exclusively comprise a combination of EAF-AOD-L (duplex process) or EAF-AOD-L (MRP-L)-VOD (triplex process).

The EAF use is different depending upon scrap iron availability or scrap iron and pig iron availability. Presently, the development of the process goes in the direction of using pig iron or liquid chromium together with a reduced portion of low-alloy or high-alloy scrap iron, combined with alloys.

The largest portion among the alloying elements forms chromium and nickel. Nickel is the priciest component. Limited resources of nickel due to the constantly growing final consumer market and, for this reason, the world production are the main reasons for the growing demand for nickel and, for this reason, the growing nickel prices.

New technologies are wanted in order to make the steel material price cost-effective.

In EP 1 641 946 B1, a process for producing an alloyed fused metal is proposed, with the goal to minimize the production costs with high quality and return waste such as Cr-containing or Cr- and Ni- containing dust and slags to the manufacturing process. The process comprises the following process steps, which are performed successively in different converters with top blowing and submerged blowing, in each process step, liquid pig iron from a pig iron mixer being charged into the respective converter:

1. Process step: producing a pre-alloyed melt with 20.3% of Cr and 2% of Ni and a temperature of 1560° C. in a recycling converter.

2. Process step: introducing a Cr carrier and an additional reducing agent, a slag-forming agent, and a fossil fuel into the first pre-alloyed molten charge in a KMS-S converter and producing an alloyed pre-melt for the third process step with 25.9% of Cr and 1.38% of Ni and a temperature of 1500° C.

3. Process step: final treatment in a K-OBM-S converter with addition of in particular ferro-alloys and performance of a decarburization process and adjustment of an alloyed steel melt with the pre-determined chemical analysis of 18.14% of Cr and 8.06% of Ni and a pre-determined temperature of 1860° C.

Another technology for producing high-grade steel is described in U.S. Pat. No. 5,514,331. In this process, the following process steps with the following exemplary results are performed:

- producing liquid ferrochromium with a content of 52% of Cr in an arc furnace;

- charging the liquid ferrochromium into a ferrochromium converter, in which molten steel with a chromium content of 35% is produced by adding lumpy carbon steel scrap;
- filling this steel melt into a transfer ladle and adding a second steel melt charge that is smelted in another arc furnace with a content of 13% of nickel and some chromium;
- filling the mixed melt, which is contained in the transfer ladle and has a content of 19% of Cr and 6.6% of Ni, into an AOD converter, wherein finally an end product having a content of 18% of Cr and 8% of Ni is produced.

Proceeding from the described prior art with the procedures for producing stainless steel with the alloying elements chromium and nickel known so far, it is the object of the invention to show a method, which allows a significant reduction of the steel production costs by directly utilizing chromium ore and nickel ore.

SUMMARY OF THE INVENTION

According to the invention, the object is procedurally solved with the characterizing features of claim 1 in that the coordinated process steps mentioned above are characterized by the following procedure performed in a process line:

- producing liquid steel with ferrochromium and liquid steel with ferronickel in two separate direct reduction processes using low-cost chromium ore or nickel ore raw material mixtures in two direct reduction furnaces, for example SAF furnaces, arranged in parallel on the primary side of a processing converter;
- tapping the liquid steel from both direct reduction furnaces into a transfer ladle, liquid steel with ferrochromium being tapped at first and liquid steel with ferronickel being tapped afterwards;
- charging the metal mixture of liquid steel with ferrochromium and liquid steel with ferronickel contained in the transfer ladle into a processing converter;
- producing the stainless steel in the desired quality in the converter by typical oxidation of the metal mixture, slag reduction, and fine adjustment of the chemical target analysis;
- tapping the produced liquid stainless steel into a foundry ladle and transporting the stainless steel to a casting machine.

By separating the production of ferrochromium and ferronickel into two direct reduction processes parallel in the process line prior to a processing converter, AOD; AOD-L or MRP; MRP-L for example being usable as converter, by direct utilization of the two ores of chromium and nickel, a significant reduction of the steel production costs is achieved. The investment costs of the reduction furnaces (Submerged Arc Furnace) with the proper installations are indeed approx. 9× higher than the classical line EAF-AOD-L, however, the raw material costs are more cost-effective in approx. the same ratio. For this reason, the investment is quickly amortizable. In addition, the process is much easier to control in the converter due to exclusive DRI (direct reduction of iron) or scrap iron addition.

The two direct reduction processes with the feedstock nickel or chromium ore taking place on the primary side of the process line supply in an approx. one hour-long cycle for example approx. 340 kg/$t_{steel}$ of liquid ferrochromium with approx. 55% of Cr and approx. 540 kg/$t_{steel}$ of liquid ferronickel with approx. 15% of Ni, each with approx. 1600° C. Both metals are tapped into a transfer ladle, in the order ferrochromium and afterwards ferronickel, and with it transported to a processing converter, in which the typical oxidation of the metal mixture with weight build-up by means of direct reduction of iron (DRI) or by means of carbon scrap in a quantity of approx. 160 kg/$t_{steel}$ is performed. Here, the DRI or carbon scrap also assumes the function of cooling the melt to compensate for the high evolution of energy by the oxidation reactions of carbon, silicon, and to some extent chromium and iron. The converter process ends with a slag reduction and fine adjustment of the chemical target analysis.

In the process according to the invention, phosphorous only occurs in small quantities, so that this element is to be considered unproblematic for the stainless steels, and higher sulfur contents are removed with sufficient efficiency in the converter process.

Below, the process according to the invention is explained in more detail by means of an exemplary embodiment of an exemplary, schematically represented process line.

BRIEF DESCRIPTION OF THE DRAWINGS:

Single Figure of the drawings shows a schematic view of a process line for implementing the inventive process.

DETAILED DESCRIPTION OF THE PREFERRED EMBODIMENT.

In the Drawing Figure, a process line 10 with individual components selected exemplarily, with which the process according to the invention may be performed, is schematically represented. The direction of the materials flow between the individual components, which is sketched in using a double arrow in each case, begins in the upper left hand corner and proceeds to the lower right hand corner in the Drawing FIGURE.

The beginning of process line 10 form two direct reduction furnaces, a SAF 3 for ferrochromium production and a SAF 4 for ferronickel production. Next to each of these direct reduction furnaces, the raw material mixtures 1, 2 to be employed are sketched-in in the form of different sized piles.

The average composition of the raw material mixtures 1, 2 for the performance of the primary direct reduction according to the invention is as follows:

Chromium ore raw material mixture 1=coke, chromium ore with 24-37% of Cr, approx. 30% of Fe Nickel ore raw material mixture 2=coke, nickel ore with 1.2-1.5% of Ni, approx. 15% of Fe.

The reduction processes, performed in SAF 3, 4 using raw material mixtures 1, 2, supply in an approx. one hour-long cycle for example:

SAF 3 approx. 340 kg/$t_{steel}$ of liquid ferrochromium with approx. 55% of Cr with approx. 1600° C. and SAF 4 approx. 540 kg/$t_{steel}$ of liquid ferronickel with approx. 15% of Ni with about the same temperature of approx. 1600° C.

After tapping these melts into a charging ladle 5, the ferrochromium being filled into the transfer ladle 5 at first and ferronickel afterwards, the following typical composition results exemplarily for the metal mixture obtained:

| C % | Si % | P % | S % | Cr % | Ni % | Temperature ° C. |
|---|---|---|---|---|---|---|
| 2.92 | 1.36 | 0.032 | 0.035 | 21.31 | 9.2 | 1600 |

Using transfer ladle 5, the metal mixture is now charged into the processing converter 6, which in the exemplary embodiment shown is an AOD-L, wherein the required last process steps for producing stainless steel with the predetermined chemical target analysis are performed. The last component of process line 10 is a continuous casting machine (CCM) 8, which is arranged downstream from the AOD-L 6, with an interposed ladle treatment station (LTS) 7.

REFERENCE NUMBER LIST

1 chromium ore raw material mixture
2 nickel ore raw material mixture
3 ferrochromium direct reduction furnace (SAF)
4 ferronickel direct reduction furnace (SAF)
5 transfer ladle (charging ladle)
6 AOD-L converter
7 foundry ladle (LTS)
8 casting machine (CCM)
10 process line

The invention claimed is:

1. A process for producing stainless steel based on chromium ore and nickel ore in several process steps coordinated via intermediate products ferrochromium and ferronickel, the process comprising the steps of:

providing a process line (10) having a processing converter (6), two direct reduction furnaces (3,4) arranged parallel to each other on a primary side of the processing converter, a transfer ladle (5) for transferring melt from the direct reduction furnaces (3, 4) to the processing converter (6), a foundry ladle (7) for transporting a produced stainless steel to a casting machine (8);

producing liquid steel with ferrochromium and liquid steel with ferronickel in two separate direct reduction processes using low-cost chromium ore material (1) and nickel ore raw material mixtures (2) in the direct reduction furnaces (3, 4), respectively;

tapping the liquid steel from the two direct reduction furnaces (3, 4) into a transfer ladle (5), liquid steel with ferrochromium being tapped first and liquid steel with ferronickel being tapped thereafter;

charging the metal mixture of the liquid steel with ferrochromium and the liquid steel with ferronickel contained in the transfer ladle (5) into the processing converter (6);

producing the stainless steel in the converter (6) by oxidation of the metal mixture, slag reduction, and adjustment of a chemical target analysis; and tapping the produced liquid stainless steel into a foundry ladle (7) and transporting the stainless steel to the casting machine (8).

2. A process according to claim 1, wherein the raw material mixtures (1, 2) charged into the direct reduction furnaces (3, 4) have the following average composition:

Chromium ore raw material mixture (1)=coke, chromium ore with 24-37% of Cr, approximately 30% of Fe, Nickel ore raw material mixture (2)=coke, nickel ore with 1.2-1.4% of Ni, approximately 15% of Fe.

3. A process according to claim 2, wherein the reduction processes performed with the chromium ore raw material and nickel ore raw material mixtures (1, 2) in direct reduction furnaces (3, 4), supply in an approximately one hour-long cycle approximately 340 kg/$t_{steel}$ of liquid ferrochromium with approximately 55% of Cr with approximately 1600° C. and approximately 540 kg//$t_{steel}$ of liquid ferronickel with approximately 15% of Ni with about the same temperature of approximately 1600° C.

4. A process according to claim 2, wherein a metal mixture consolidated from direct reduction furnaces (3, 4) in transfer ladle (5) has the following composition:

| C % | Si % | P % | S % | Cr % | Ni % | Temperature ° C. |
|---|---|---|---|---|---|---|
| 2.92 | 1.36 | 0.032 | 0.035 | 21.31 | 9.2 | 1600. |

5. A process according to claim 1, wherein an AOD (Argon, oxygen decarburization converter), AOD-L (Argon, Oxygen decarburization converter with a lance) or a MRP (Metal Refining Process Converter), MRP-L (Metal Refining Process Converter with a lance) is used as the processing converter (6).

6. A process according to claim 5, wherein the oxidation of the metal mixtures in the processing converter (6), with weight build-up by means of direct reduction of iron (DRI) or by means of carbon scrap in a quantity of approximately 160 $kg/t_{steel}$, is performed with simultaneous cooling of the melt to compensate for a high evolution of energy by the oxidation reactions of carbon, silicon and partially of chromium and iron.

7. A process according to claim 1, wherein each of the two direct reduction furnaces (3, 4) is formed as a SAF (submerged arc furnace) furnace, and the processing converter (6) is formed as an AOD converter.

* * * * *